United States Patent [19]

Knapp et al.

[11] Patent Number: 4,462,017

[45] Date of Patent: Jul. 24, 1984

[54] HIGH VOLTAGE AIR CORE REACTOR

[75] Inventors: Harold M. Knapp; Bernard A. Tremblay, both of Pittsfield, Mass.

[73] Assignee: General Electric Company, King of Prussia, Pa.

[21] Appl. No.: 410,224

[22] Filed: Aug. 23, 1982

[51] Int. Cl.[3] ..... H01F 27/30

[52] U.S. Cl. ..... 336/207; 336/196; 336/199; 336/205

[58] Field of Search ..... 336/196, 199, 205, 207

[56] References Cited

U.S. PATENT DOCUMENTS

| | | | |
|---|---|---|---|
| 1,412,817 | 4/1922 | Kierstead | 307/156 |
| 1,535,584 | 4/1925 | Dorfman | 249/97 |
| 1,575,929 | 3/1926 | Murray | 264/278 |
| 1,579,883 | 4/1926 | Murray | 336/205 |
| 2,372,950 | 4/1945 | Holmberg et al. | 175/359 |
| 2,892,168 | 6/1959 | Seidel et al. | 336/207 |
| 2,959,754 | 11/1960 | McKinnon et al. | 336/207 X |
| 3,621,429 | 11/1971 | Benke | 336/207 X |

*Primary Examiner*—G. P. Tolin
*Assistant Examiner*—Susan Steward
*Attorney, Agent, or Firm*—Robert A. Cahill; William Freedman

[57] ABSTRACT

A high voltage reactor includes a plurality of angularly spaced columns for supporting the layers of a disk winding in vertically spaced relation. Each of the columns is comprised of a monolithic casting of an insulative material and pairs of angularly spaced, rigid plastic casting forms disposed between each winding layer. The form pairs are in vertical alignment to establish requisite layer-to-layer and turn-to-turn separations, as well as to provide the sidewalls of a casting mold utilized in forming the column. The forms thereafter remain in place to constitute the column sidewalls.

7 Claims, 8 Drawing Figures

HIGH VOLTAGE AIR CORE REACTOR

BACKGROUND OF THE INVENTION

The present invention relates to electrical reactors and more particularly to high voltage air core reactors for use in electrical power distribution systems.

1. Field of the Invention

High voltage air core reactors or power reactors are extensively used as components in electrical power distribution systems for a variety of well known purposes. Thus, there are current limiting reactors, filter reactors, ripple reactors, and shunt reactors, to name the more traditional types of power reactors. With the increased efficiencies of utility power distribution systems, these power reactors are subjected to increasingly higher levels of transient and fault currents. Associated with these high level currents flowing through power reactors are tremendous electrodynamic forces exerted on the coil turns. Consequently, the coil supporting structure must be mechanically robust if the power reactor is to survive the extremely high level fault and transient currents now commonplace in power distribution systems.

2. Description of the Prior Art

Presently, so-called "concrete" reactors are utilized to meet the mechanical design requirements of power reactors. Concrete reactors are characterized by an angular array of spaced columns cast in Portland cement or the like and in which the coil turns are imbedded. While concrete is quite adequate in compressive strength, it is not particularly strong in tension. To meet the current demands for a more robust coil supporting structure, the cross-section of the concrete columns must be enlarged or increased in number. In either case, the separation between columns is reduced. Consequently, a higher percentage of the reactor coil surface area is imbedded in concrete, leaving a lower percentage available for air cooling, which ideally is achieved by natural convection. Thus, unless extraordinary cooling measures are applied, the power reactor runs hotter and its losses increase.

It is accordingly an object of the present invention to provide a power reactor of significantly improved mechanical strength.

A further object is to provide a power reactor of the above character wherein its air-cooled efficiency is not prejudiced.

Another object of the present invention is to provide a power reactor of the above character which is efficient in design and operation, convenient to manufacture, and reliable in service.

Other objects of the invention will in part be obvious and in part appear hereinafter.

SUMMARY OF THE INVENTION

In accordance with the present invention, there is provided an air core power reactor having an angular array of spaced columns in which circumferential portions of the coil turns are imbedded to thus support the plural layers of a disk winding in vertically spaced relation. Each column is comprised of a monolithic casting of an insulative material of high mechanical strength in both tension and compression, and a plurality of pairs of angularly spaced, rigid plastic casting forms. The form pairs, positioned between the disk winding layers, are in vertical alignment to serve as the sidewalls for a casting mold utilized in forming the column. The forms remain in place after the column material is cured to constitute the column sidewalls. The forms are structured to interfit with removable mold end members and with their vertically adjacent neighbor to provide casting mold integrity and to establish the requisite layer-to-layer and turn-to-turn separations.

The present invention accordingly comprises the features of construction, combination of elements, and arrangement of parts which will be exemplified in the construction hereinafter set forth, and the scope of the invention will be indicated in the claims.

For a fuller understanding of the nature and objects of the invention, reference should be had to the following description taken in connection with the accompanying drawings, in which:

BRIEF DESCRIPTION OF THE DRAWINGS

Corresponding reference numerals refer to like parts throughout the several views of the drawings.

DESCRIPTION OF THE PREFERRED EMBODIMENT

Figure 1:
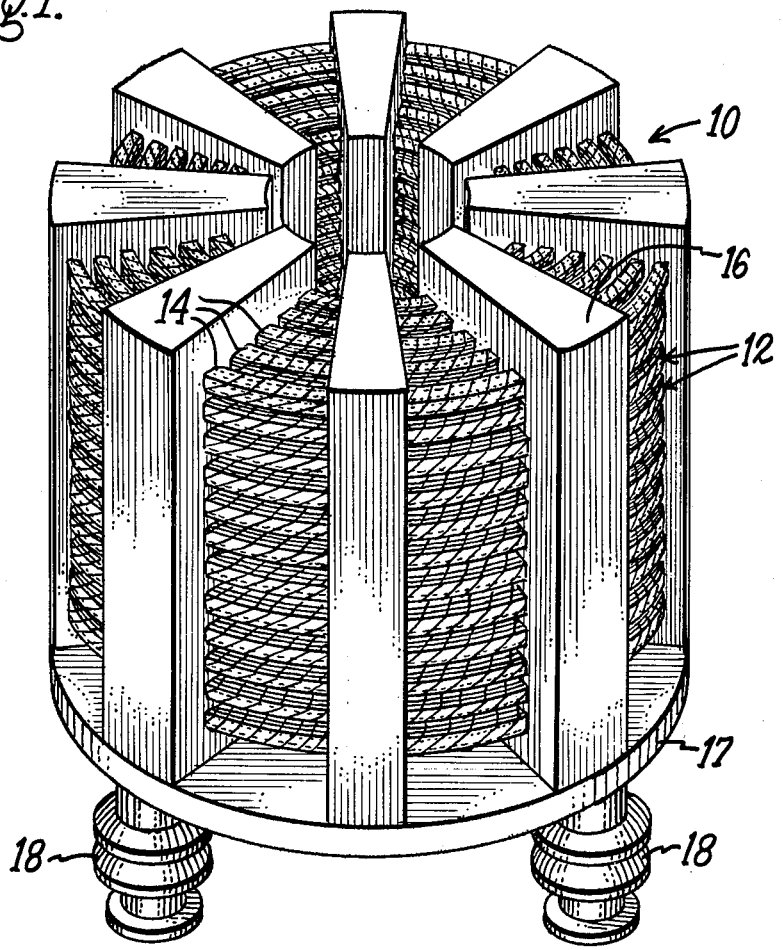
FIG. 1 is a perspective view of a power reactor constructed in accordance with the present invention.

The power reactor of the present invention, seen in FIG. 1, includes a disk winding, generally indicated at 10, consisting of a plurality of vertically spaced layers, generally indicated at 12, each having radially spaced turns 14. The winding turns are imbedded in a plurality of angularly spaced vertical support columns 16 in the form of a monolithic casting of a polymer material, such as a cured sand-filled cycloaliphatic epoxy resin. The angular separation of the columns 16, together with the open central region (air core) of the reactor, exposes a sufficient percentage of winding surface area to achieve adequate air cooling by natural convection. A floor 17 of an insulative material, such as glass-filled polyester, is positioned beneath the columns to serve as a barrier, while the reactor is spaced from its mounting surface by a plurality of insulative standoffs 18.

Figure 2:
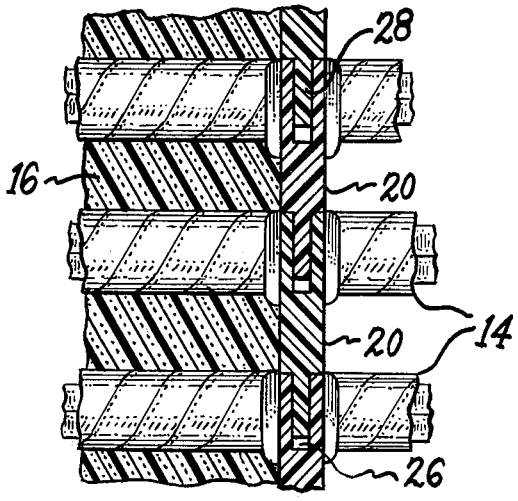
FIG. 2 is a fragmentary sectional view of one of the columns of the power reactor of FIG. 1.
Figure 3:
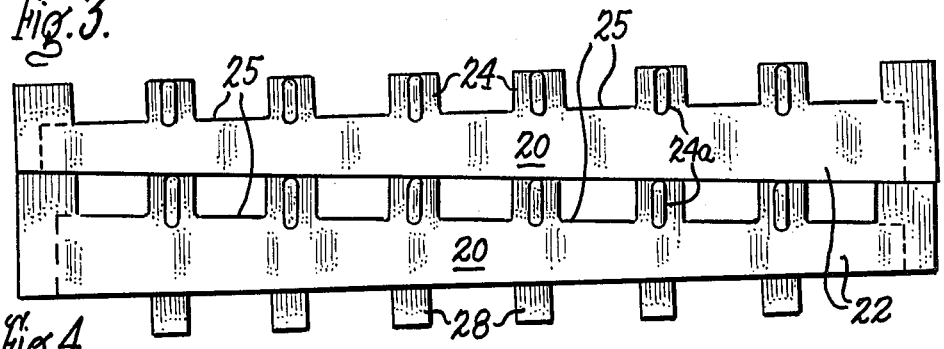
FIG. 3 is a side elevational view of two vertically adjacent casting forms utilized in the reactor columns of FIG. 1.

In accordance with a feature of the present invention, the exposed column sidewalls, as seen in FIG. 2, are lined with a vertical array of interfitting casting forms 20 which are molded from a rigid plastic material, such as glass-filled polyester. As will be seen, these forms serve the multiple functions of establishing the requisite vertical separation between winding layers 12 and the requisite radial separation between adjacent coil turns 14 in a winding layer, as well as providing the sidewalls of a mold utilized in casting the columns. Once the polymer casting is cured, the forms become intimately bonded thereto and thus remain in place to constitute permanent exterior sidewalls for columns 16.

Figure 4:
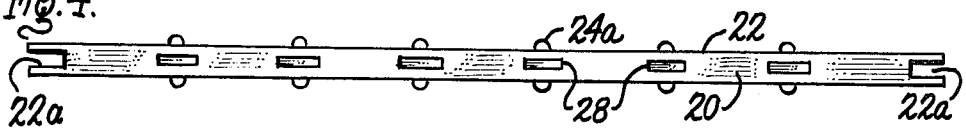
FIG. 4 is a bottom view of one of the casting forms of FIG. 3.
Figure 5:
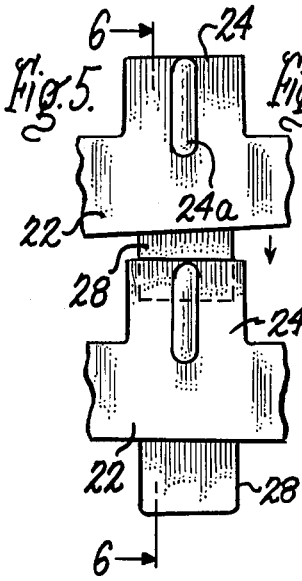
FIG. 5 is an enlarged, fragmentary side elevational view of the two casting forms of FIG. 3, illustrating how they slideably interfit.
Figure 6:
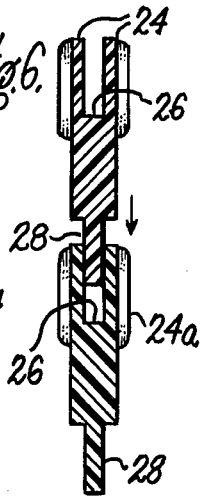
FIG. 6 is a sectional view taken along line 6—6 of FIG. 5.

Referring jointly to FIGS. 3 through 6, each casting form 20 includes an elongated body 22 whose vertical extent is tapered from one end to the other. Upstanding from the body along its length are a plurality of uniformly spaced pairs of laterally separated fingers 24 serving to define a notch 26 therebetween. The spaces between finger pairs provide recesses 25. Vertically aligned with each finger pair is a tab 28 depending from body 22. As seen in FIGS. 5 and 6, when vertically adjacent forms 20 are nested together, tabs 28 are slidingly received in notches 26 in reasonably snug-fitting fashion. To afford fingers 24 added strength, reinforcing ribs 24*a* are preferably molded into the exterior sides thereof. As seen in FIG. 4, at each end of the form body there is provided a vertically extending groove 22*a* which communicates with the notch 26 provided by the finger pair 24 thereat.

Figure 7:
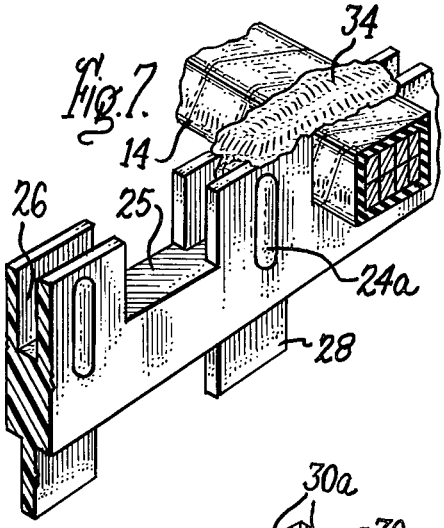
FIG. 7 is an enlarged, fragmentary perspective view of one of the casting forms of FIG. 4, illustrating its accommodation of a reactor coil turn.
Figure 8:
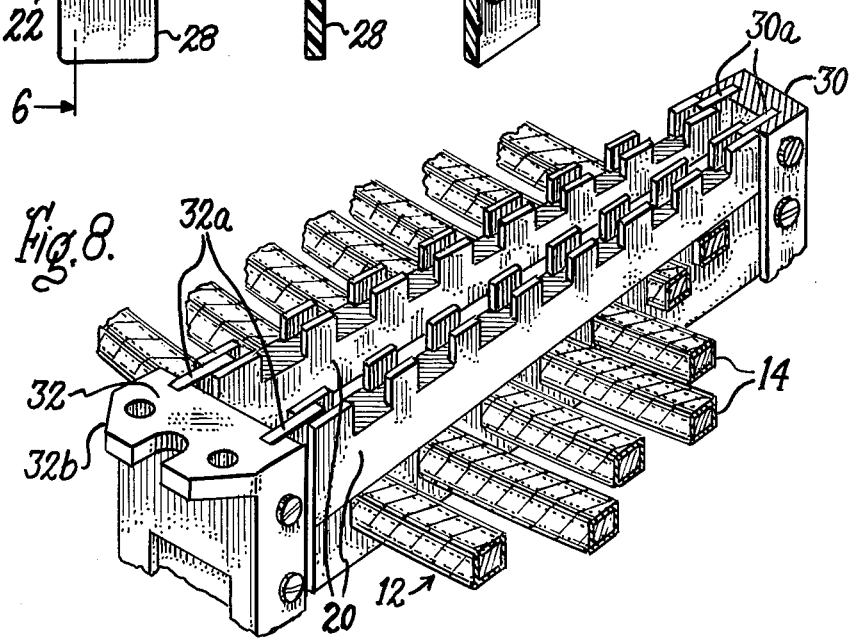
FIG. 8 is a perspective view of two vertically adjacent, angularly spaced pairs of casting forms, illustrating their utilization in casting mold for the reactor columns.

Turning to FIGS. 7 and 8, to cast each column 16, a pair of inner and outer end mold members 30 and 32, respectively, are stationed in upright positions at each eventual column location. The inner end mold member is provided with a pair of coextensive, outwardly projecting flanges 30*a* in laterally spaced relation. Similarly, the outer end mold member is provided with a pair of coextensive, inwardly projecting flanges 32*a* in laterally spaced relation. It is noted that the inner flanges are more closely spaced than the outer flanges to give the columns their wedge-shape cross-section seen in FIG. 1. This is common practice in concrete reactors to provide the requisite increasing strength as the winding turns spiral radially outward. Prior to the creation of each winding layer 12, a pair of casting forms 20 are installed at each column location with the inner and outer flanges 30*a* and 32*a* received in the form end grooves 22*a*. Preferably, the inner and outer end mold members 30 and 32 are built up to their full vertical extent in sections so as not to unduly obstruct the winding operation. To this end, the end member sections are provided with suitable bracketing, as indicated at 32*b* in FIG. 8, to facilitate the joining of sections together as the reactor disk winding is built up.

With a full annular complement of casting forms 20 in place, a winding layer 12 can then be wound. As each turn 14 of the winding cable is played out from the supply spool (not shown), it is lodged in a corresponding radially located recess 25 in each casting form 20. The next turn is lodged in the next adjacent recesses and so on as a winding layer 12 is developed by progressing either radially outward or inward. Upon completion of a winding layer, another annular complement of casting forms is installed with their tabs 28 received in notches 26 of the previously installed forms and their grooves 22*a* accommodating the end mold member flanges 30*a*, 32*a*. A cable transition is then made to the level of the next winding layer, and the turns 14 lodged in the appropriate form recesses 25. If the transition from one layer to the next is made at the inner end of the completed layer, the next annular complement of forms 20 are installed as shown in FIG. 8 with the tapered down ends of the form bodies 22 directed inwardly. This is done to conserve space since the minimal voltage differential between the last turn 14 of one layer and the first turn of the next layer, which are in reality consecutive turns, requires little physical separation. This places the tapered up ends of the form bodies at the outer periphery of the reactor in the depiction of FIG. 8 where maximum separation is established between the first turn of the layer shown and the last turn of the layer to be next completed. From the standpoint of voltage, these turns are separated by the voltage drops across virtually two full layers. From this, it will be appreciated that the orientations of the casting forms are simply reversed end-to-end from one level to the next.

From FIGS. 5 and 6, it is seen that when the vertically adjacent complements of casting forms are nested or fitted together with tabs 28 received in finger notches 26, the winding turns are effectively captured in place between vertically adjacent forms. It will be appreciated that the longitudinal dimension of the fingers 24 will vary in practice depending upon the turn-to-turn spacing required for a particular reactor voltage rating. Also, the vertical extents of the fingers 24 and tabs 28, as well as the longitudinal dimension of recesses 25, will vary according to cable size. It will be appreciated that the forms can be readily modified to accept round rather than rectangular cable.

To insure a fluid tight mold, a bead of a suitably compatible sealant, indicated at 34 in FIG. 7, is laid across the tops of the casting forms 20 upon the completion of winding layer. Thus, when the next level of forms are installed, the sealant is forced down into notches 26 and into recesses 25 to fill the voids between the cable and the forms. To this end, the length of tabs 28 is made less than the depth of notches 26, as can be seen from FIG. 2.

When the reactor is wound to its full vertical extent, the casting forms 20, together with end mold members 30 and 32, are in place ready to receive the resin for casting columns 16, which is simply poured in from the top. After the molds are topped off, the reactor is moved to an oven to cure the columns. The end mold members are removed, but the coating forms 20 are not. Rather, they remain, intimately bonded to the cured resin, to thereafter provide the sidewalls for columns 16, as described in conjunction with FIG. 2. The resulting polymer reactor has considerably more structural strength than a concrete reactor, yet is lighter in weight. Moreover, the cast polymer columns supporting the winding turns expose ample winding surface area to insure more than adequate ventilation by natural air convection.

It is thus seen that the objects set forth above, as well as those made apparent in the preceding description, are efficiently attained, and, since certain changes may be made in the above construction without departing from the scope of the invention, it is intended that all matters contained in the above description or shown in the accompanying drawings shall be interpreted as illustrative and not in a limiting sense.

Having described our invention, what we claim as new and desire to secure by Letters Patent is:

1. An electrical power reactor comprising, in combination:

A. a disk winding arranged in a plurality of vertically spaced, multi-turn layers; and B. an annular array of angularly spaced columns supporting said disk winding layers, each said column including (1) a monolithic casting of an insulative material in which portions of the layer turns are imbedded; and (2) a pair of radially extending, angularly spaced casting forms positioned between each winding layer and formed of a rigid plastic material, said form pairs establishing the vertical spacing between said winding layers and the radial spacing between layer turns, each said form pair cooperating with vertically adjacent form pairs to provide the sidewalls of a casting mold for said column and remaining in place to constitute permanent exterior sidewalls for said column, each said casting form includes:

a. an elongated body dimensioned to establish the desired vertical spacing between said winding layers, b. a plurality of vertically extending fingers integrally formed with said body in spaced relation along the upper edge thereof, said fingers defining recesses therebetween for receipt of individual layer turns and being dimensioned to establish the radial spacing between said layer turns, and c. means integrally formed with said body along the lower edge thereof for overlapping engagement with said fingers of a vertically adjacent casting mold in providing a casting mold sidewall.

2. The power reactor defined in claim 1, wherein each said finger is bifurcated to provide a laterally spaced finger pair defining a notch therebetween, said means integrally formed along the lower edge of each said casting form body comprising a plurality of vertically extending tabs spaced along the length thereof in opposed relation with said finger pairs, said tabs of one casting form being slidingly received in said notches of a vertically adjacent casting form.

3. The power reactor defined in claims 1 or 2, wherein each said casting form body includes means at each end thereof for fitted engagement with end mold members cooperating with said casting forms in providing a complete column casting mold.

4. The power reactor defined in claims 1 or 2 wherein each said column includes a sealant applied to said casting forms as each said layer is wound to seal said layer turns in said recesses and thereby promote a fluid tight column casting mold.

5. The power reactor defined in claims 1 or 2, wherein each said form body is tapered in its vertical dimension from one of its ends to the other.

6. The power reactor defined in claims 1 or 2, wherein said column insulative material is a cured polymer resin.

7. The power reactor defined in claims 1 or 2, wherein said column insulative material is a sand-filled cycloaliphatic epoxy resin.

* * * * *